United States Patent [19]

Raymond

[11] 4,336,701

[45] Jun. 29, 1982

[54] KEYING PROCESS FOR RESETTABLE LOCK

[76] Inventor: James W. Raymond, 1801 Port Margate Pl., Newport, Calif. 92660

[21] Appl. No.: 847,080

[22] Filed: Oct. 31, 1977

Related U.S. Application Data

[63] Continuation of Ser. No. 723,938, Sep. 16, 1976, abandoned.

[51] Int. Cl.[3] ..... E05B 19/00

[52] U.S. Cl. ..... 70/395; 70/408

[58] Field of Search ..... 70/395, 40 C, 408; 40/330

[56] References Cited

U.S. PATENT DOCUMENTS

| | | | |
|---|---|---|---|
| 868,948 | 10/1907 | Strauss | 40/330 |
| 1,032,293 | 7/1912 | Nordenbold | 40/330 |
| 1,219,706 | 3/1917 | Dahne | 40/330 |
| 1,816,642 | 7/1931 | Fetter | 40/330 |
| 2,058,862 | 10/1936 | Golden | 40/330 |
| 3,208,249 | 9/1965 | Stackhouse | 70/395 |
| 3,324,586 | 6/1967 | Mitchell | 40/330 |

*Primary Examiner*—Robert L. Wolfe

*Attorney, Agent, or Firm*—Keith D. Beecher

[57] ABSTRACT

A keying process is provided for use in hotels or motels in conjunction with resettable room locks, so that an immediate indication is provided by the key itself as to whether it is the current key for the lock of a particular room. The key is provided with a serial number which identifies the key so that it may be grouped with its duplicates. The key is also provided with a removable plug which identifies the particular room whose lock has been set currently to accept the key. Two, or more, differently colored plugs are provided for each room, and each time the lock of a particular room is reset to accept a new key, the new key is provided with a room-identifying plug of a different color from the previous key. The key slots at the hotel or motel desk may be provided with correspondingly colored lights, or other color indicators, and the color indicator corresponding to the color of the current plug is activated for each slot. Any keys turned in to the desk which do not have a plug with the current color, instead of being returned to the slot, are sent to the maintenance center where the plugs are removed, and the keys and plugs are stored separately for future use.

3 Claims, 3 Drawing Figures

KEYING PROCESS FOR RESETTABLE LOCK

This application is a continuation of Copending Application Ser. No. 723,938, filed Sept. 16, 1976 and now abandoned.

BACKGROUND OF THE INVENTION

Resettable locks have been produced in the prior art for hotels and motels, which can be reset after each room occupancy. In this way, lost or stolen keys are ineffective to gain access to the room at a future date. Such a resettable lock is described, for example, in U.S. Pat. No. 3,938,358.

The keying process of the present invention finds particular utility with resettable hotel or motel locks of the type described, for example, in the aforesaid patent. The key is constructed to permit the establishment to change the lock of any room after each occupancy, and yet to maintain an efficient system for detecting prior keys used for a particular room and for removing such keys from service.

DETAILED DESCRIPTION OF THE ILLUSTRATED EMBODIMENT

Figure 1:
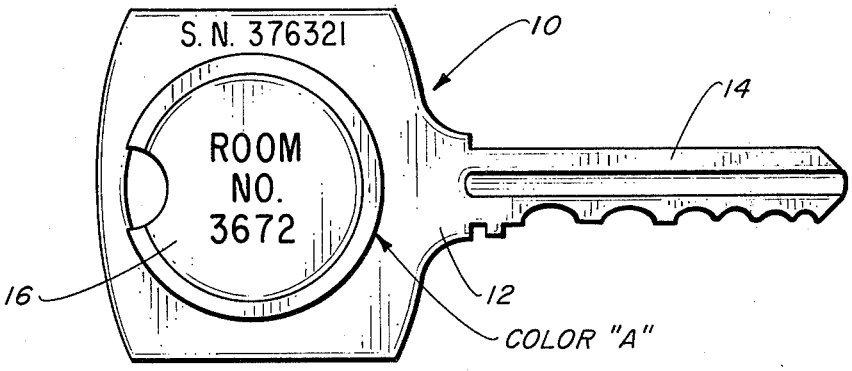
FIG. 1 is a representation of a typical key for use in the process embodying the concepts of the invention, and supplied with a first removable plastic room-identifying plug.
Figure 2:
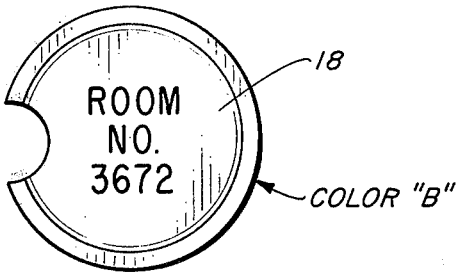
FIG. 2 represents a second plastic room-identifying plug which also may be inserted into the key of FIG. 1 to replace the first plug.

The key illustrated in FIG. 1 is designated 10, and it includes a handle portion 12 and a serrated stem portion 14.

A hole is provided in the handle portion, and a room-identifying plug 16 is removably fitted into the opening. The plug 16 is formed of any appropriate plastic, or other material, and is held in the opening in the handle with a snap-fit engagement.

As shown, the key 10 has a particular serial number inscribed on its handle, or at any other appropriate place, so the key may be grouped with its duplicates when not in use. The plug 16, on the other hand, carries the room number whose lock is presently set to accept the particular key. As described above, the plug 16 may be provided with a particular color, and a second room-identifying plug 18 may also be provided of a different color. Then, whenever the lock is changed for a particular room, the plug 18 is inserted in the new key, so that it may readily be distinguished from the previous key.

Figure 3:
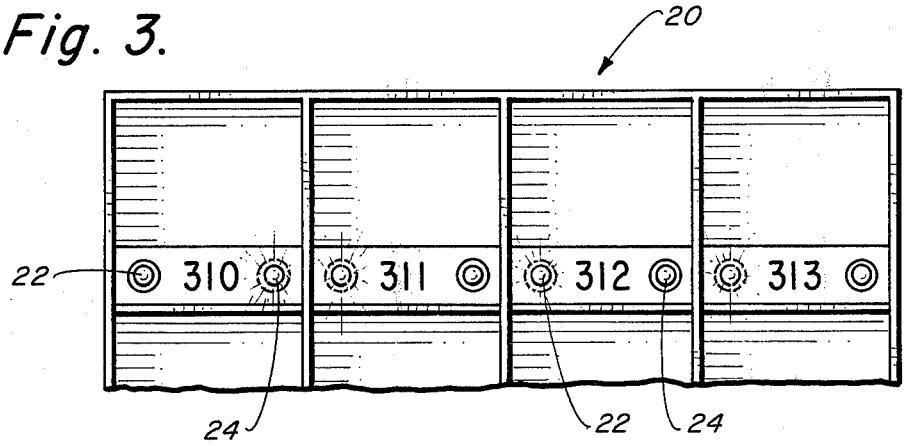
FIG. 3 is a partial representation of typical key slots used in a hotel or motel.

A bank of key slots 20 is shown in FIG. 3, these slots usually being positioned behind the desk at the hotel or motel. Each key slot is provided with a pair of lights, or other indicators 22 and 24 of colors matching the colors of the plugs 16 and 18. Then, when the current key has a particular color, the corresponding indicator 22 or 24 is activated.

Whenever a key is turned in to the desk of the activated color, it is returned to the slot for future use. However, when a key is turned in of a different color, it is returned to the maintenance room, as indicated above.

It will be appreciated that while a particular embodiment of the process of the invention has been shown and described, modifications may be made. It is intended in the claims to cover the modifications which come within the spirit and scope of the invention.

What is claimed is:

1. A process for use in conjunction with resettable room locks in a hotel, motel, or the like, including: providing a plurality of keys each having a stem portion and a handle portion having an opening therein; providing identifying indicia on said keys; grouping said keys with duplicates having the same identifying indicia; providing a plurality of plug members all having the same room number inscribed thereon; causing said plug members to be selectively removably retained in said opening in each of said key; causing said plugs to be replaced by one another each time a corresponding resettable room lock is changed; causing each of said plugs to include means for distinguishing it from the other plugs; and indicating the current key for any resettable room lock as established by the distinguishing means of the plug inserted into the current key.

2. The process defined in claim 1, in which said distinguishing means comprises a different color for each of said plugs.

3. The process defined in claim 1, in which said plugs are formed of plastic material and are each retained in said opening in a snap-fit relationship.

* * * * *